US010998160B2

(12) United States Patent
Steinlage et al.

(10) Patent No.: US 10,998,160 B2
(45) Date of Patent: May 4, 2021

(54) CATHODE EMITTER TO EMITTER ATTACHMENT SYSTEM AND METHOD

(71) Applicant: General Electric Company, Schenectady, NY (US)

(72) Inventors: Gregory Steinlage, Milwaukee, WI (US); Andrew Marconnet, Milwaukee, WI (US); Sandhya Abhivandana Dammu, Milwaukee, WI (US); Evan Lampe, Milwaukee, WI (US); Edward Emaci, Milwaukee, WI (US); Michael Utschig, Milwaukee, WI (US); Donald Allen, Waukesha, WI (US); Richard Brogan, Milwaukee, WI (US)

(73) Assignee: General Electric Company, Schenectady, NY (US)

( * ) Notice: Subject to any disclaimer, the term of this patent is extended or adjusted under 35 U.S.C. 154(b) by 80 days.

(21) Appl. No.: 16/106,262

(22) Filed: Aug. 21, 2018

(65) Prior Publication Data

US 2020/0066475 A1 Feb. 27, 2020

(51) Int. Cl.
*H01J 35/06* (2006.01)
*H01J 9/04* (2006.01)

(52) U.S. Cl.
CPC ..... *H01J 35/06* (2013.01); *H01J 9/04* (2013.01)

(58) Field of Classification Search
CPC ..... H01J 35/06; H01J 9/04
USPC ..... 378/136
See application file for complete search history.

(56) References Cited

U.S. PATENT DOCUMENTS 5,146,481 A * 9/1992 Garg ..... C23C 16/271 378/35
5,198,720 A * 3/1993 Choi ..... H01J 1/18 313/271
6,259,193 B1 * 7/2001 Lipkin ..... H01J 1/18 313/271
7,785,113 B2 * 8/2010 Mizoguchi ..... H01R 12/58 439/67
9,466,455 B2 * 10/2016 Hubbard ..... H01J 35/06
9,472,371 B2 10/2016 Virshup et al.
(Continued)

FOREIGN PATENT DOCUMENTS

WO 2017161161 9/2017

*Primary Examiner* — David P Porta
*Assistant Examiner* — Gisselle M Gutierrez

(57) ABSTRACT

A pair of straight or angularly oriented flat emitters formed of an electron emissive material are positioned on an emitter support structure and are electrically connected to one another regardless of the mounting structure on which the emitters are positioned. The electrical connections between the emitters are formed directly between the emitters using electrically conductive material members that are placed between and affixed to the emitters to provide the electrical pathway or connection therebetween the emitters after formation of the emitters. These electrical connection members form an electrical connection between the angled pair of emitters separately from an emitter support structure on the cathode, such that the electrical connection members and angled emitters including the connection members can separate the mechanical architecture of the cathode assembly from the electrical architecture, thereby creating a simplified construction for the cathode assembly and associated x-ray tubes.

20 Claims, 6 Drawing Sheets

(56) References Cited

U.S. PATENT DOCUMENTS

| | | | | |
|---|---|---|---|---|
| 2002/0168050 | A1* | 11/2002 | Ochiai | H01J 3/028 378/119 |
| 2005/0082984 | A1* | 4/2005 | Wada | H01J 61/36 313/623 |
| 2010/0195797 | A1* | 8/2010 | Hauttmann | H01J 1/13 378/136 |
| 2010/0278307 | A1* | 11/2010 | Moore | H01J 35/06 378/136 |
| 2010/0284519 | A1* | 11/2010 | Moore | H01J 1/20 378/136 |
| 2010/0316192 | A1* | 12/2010 | Hauttmann | H01J 35/06 378/136 |
| 2011/0117786 | A1* | 5/2011 | Takata | F21K 9/272 439/628 |
| 2016/0172149 | A1* | 6/2016 | Tezuka | H01J 35/06 378/137 |
| 2017/0271116 | A1 | 9/2017 | Virshup et al. | |
| 2017/0287671 | A1* | 10/2017 | Lemaitre | H01J 35/14 |

* cited by examiner

CATHODE EMITTER TO EMITTER ATTACHMENT SYSTEM AND METHOD

BACKGROUND OF THE DISCLOSURE

The invention relates generally to x-ray tubes, and more particularly to structures for emitters utilized in an x-ray tube to properly position the emitters within the x-ray tube.

X-ray systems may include an x-ray tube, a detector, and a support structure for the x-ray tube and the detector. In operation, an imaging table, on which an object is positioned, may be located between the x-ray tube and the detector. The x-ray tube typically emits radiation, such as x-rays, toward the object. The radiation passes through the object on the imaging table and impinges on the detector. As radiation passes through the object, internal structures of the object cause spatial variances in the radiation received at the detector. The detector then emits data received, and the system translates the radiation variances into an image, which may be used to evaluate the internal structure of the object. The object may include, but is not limited to, a patient in a medical imaging procedure and an inanimate object as in, for instance, a package in an x-ray scanner or computed tomography (CT) package scanner.

Presently available medical X-ray tubes typically include a cathode assembly having one or more emitters thereon. The cathode assembly is oriented to face an X-ray tube anode, or target, which is typically a planar metal or composite structure. The space within the X-ray tube between the cathode and anode is evacuated.

The emitter(s) functions as an electron source that releases electrons at high acceleration. Some of the released electrons may impact the target anode. The collision of the electrons with the target anode produces X-rays, which may be used in a variety of medical devices such as computed tomography (CT) imaging systems, X-ray scanners, and so forth. In thermionic cathode systems, an emitter is included that may be induced to release electrons through the thermionic effect, i.e. in response to being heated. This emitter is often a flat surface emitter (or a 'flat emitter') that is positioned on the cathode with the flat surface positioned orthogonal to the anode, such as that disclosed in U.S. Pat. No. 8,831,178, incorporated herein by reference in its entirety for all purposes. In the '178 patent a flat emitter with a rectangular emission area is formed with a very thin material having electrodes attached thereto, which can be significantly less costly to manufacture compared to emitters formed of wound (cylindrical or non-cylindrical) filaments and may have a relaxed placement tolerance when compared to a wound filament emitter.

Typical flat emitters are formed with an electron emissive material, such as tungsten, having a flat electron emission surface divided by slots with a number of interconnects to create either a single meandering current carrying path including a number of spaced but interconnected ribbons, or multiple parallel current carrying paths, that generate electrons when heated above some temperature. Current is directly applied from the cathode through the flat emitter to generate heat in the emitter and results in the emitter surface reaching temperatures high enough to produce electron emission, typically above 2000° C.

In many x-ray tubes, multiple, i.e., pairs of flat emitters are used to generate the electron beams utilized to create the x-rays emitted from the tube. In some x-ray tubes employing multiple emitters, the pairs of emitters are oriented flat or planar with respect to one another within the cathode assembly and are electrically connected to one another to provide a current flow through both of the pairs of emitters to enable concurrent operation of the emitters. The required electrical connection can readily be made during the construction of the emitters as the emitters are disposed in a planar configuration and can be formed with a planar electrical connection directly between the emitters. In this configuration, while the use of multiple emitters provides an increase in the beam strength and/or size, it is necessary to consequently increase the focusing capacity of the tube in order to properly direct the electron beam produced by the pair of planar flat emitters.

In other x-ray tubes employing pair of flat emitters, the emitters are positioned at angles with respect to one another within the cathode assembly. The angled position of the emitters enable the beams created by the emitters to be focused more easily towards the desired focal spot based upon the direction of the electron beam emitted from the angled emitters. In certain prior art x-ray tubes, the angled pair of emitters are operated independently of one another in order to emit an electron beam that can be readily focused on the desired focal spot by the focusing components of the x-ray tube. In this configuration, the emitters do not need to be electrically connected to one another due to their independent operation.

However, in other x-ray tubes the pair of angled emitters are operated in conjunction with one another and thus need to be disposed in electrical connection with one another for current to flow between the emitters. However, the angled configuration of the emitters prevents any electrical connection from being created between the emitters during the formation of the emitters, similarly to a pair of planar emitters, as any bending or other deformation of the material forming the emitters after formation can significantly thin and/or weaken the material, greatly shortening the useful life of the emitter. As such, in the x-ray tubes employing angled pairs of emitters, the electrical connection of the emitters in prior art cathode assemblies is facilitated by the underlying structure of the cathode on which the emitters are positioned. As such, the tolerance for the proper placement of the emitters on the cathode structure is very small in order to ensure that the emitters are in electrical connection with one another. This in turn requires extremely precise manufacturing and placement of the emitters on the cathode to properly connect the emitters to the cathode and to one another.

As a result, it is desirable to develop a system and method for the electrical connection of paired flat emitters that are angularly positioned with regard to one another within an x-ray tube that is designed to readily and reliably electrically connect the emitters to one another while accommodating for variances in the placement of the emitters on the cathode and in the structure of the cathode assembly.

BRIEF DESCRIPTION OF THE DISCLOSURE

In the disclosure, a pair of flat emitters formed of an electron emissive material are positioned on a cathode assembly at an angular position with regard to one another and are readily and reliably electrically connected to one another regardless of the mounting structure of the cathode assembly on which the emitters are positioned. The electrical connections between the emitters are formed directly between the emitters using electrically conductive material members that are placed between and affixed to the emitters to provide the electrical pathway or connection therebetween the emitters after formation of the emitters.

According to one aspect of an exemplary embodiment of the invention, the angled pair of emitters can be formed as desired to have the desired electron beam emission from the emitter when current is passed through the emitters. The emitters are disposed on a suitable support to orient the emitters at the desired angular position with regard to one another. In this position, an electrical connecting member is placed between the emitters at a location where the connecting member can facilitate and electrical connection between the emitters. In certain exemplary embodiments, the emitters can be positioned on a cathode assembly to properly orient the emitters with regard to one another prior to placing the electrical connector between the emitters. In other exemplary embodiments, the electrical connectors can be affixed directly to the emitters in a suitable manner to provide the desired electrical connection.

Therefore, with one or more of these electrical connection members forming an electrical connection between the angled pair of emitters separately from an emitter support structure on the cathode, in certain exemplary embodiments of the invention, the electrical connection members and angled emitters including the connection members can function to separate the mechanical architecture of the cathode assembly from the electrical architecture, thereby creating a simplified construction for the cathode assembly and associated x-ray tubes.

In another exemplary embodiment of the disclosure, an emitter structure adapted for use with an x-ray tube includes a first emitter including at least one emission region, a second emitter including at least one emission region, the second emitter angularly disposed with respect the first emitter and spaced from the first emitter to define a gap between the first emitter and the second emitter and at least one electrical connecting member consisting of a structure extending across the gap between the first emitter and the second emitter.

In still another exemplary embodiment of the disclosure, an x-ray tube includes a cathode assembly and an anode assembly spaced from the cathode assembly, the cathode assembly having an emitter support structure and an emitter structure disposed on the emitter support structure, the emitter including a first emitter including at least one emission region, a second emitter including at least one emission region, the second emitter angularly disposed with respect the first emitter and spaced from the first emitter to define a gap between the first emitter and the second emitter; and at least one electrical connecting member consisting of a structure extending across the gap between the first emitter and the second emitter.

In another exemplary embodiment of a method of the disclosure, a method for forming an emitter structure used in an x-ray tube includes the steps of providing a first emitter including at least one emission region, providing a second emitter including at least one emission region, positioning the first emitter and the second emitter adjacent one another to define a gap between the first emitter and the second emitter and securing at least one electrical connecting member between the first emitter and the second emitter across the gap.

It should be understood that the brief description above is provided to introduce in simplified form a selection of concepts that are further described in the detailed description. It is not meant to identify key or essential features of the claimed subject matter, the scope of which is defined uniquely by the claims that follow the detailed description.

Furthermore, the claimed subject matter is not limited to implementations that solve any disadvantages noted above or in any part of this disclosure.

DETAILED DESCRIPTION OF THE DISCLOSURE

In the following detailed description, reference is made to the accompanying drawings that form a part hereof, and in which is shown by way of illustration specific embodiments, which may be practiced. These embodiments are described in sufficient detail to enable those skilled in the art to practice the embodiments, and it is to be understood that other embodiments may be utilized and that logical, mechanical, electrical and other changes may be made without departing from the scope of the embodiments. The following detailed description is, therefore, not to be taken in a limiting sense.

Exemplary embodiments of the invention relate to an X-ray tube including an increased emitter area to accommodate larger emission currents in conjunction with microsecond X-ray intensity switching in the X-ray tube. An exemplary X-ray tube and a computed tomography system employing the exemplary X-ray tube are presented.

Figure 1:
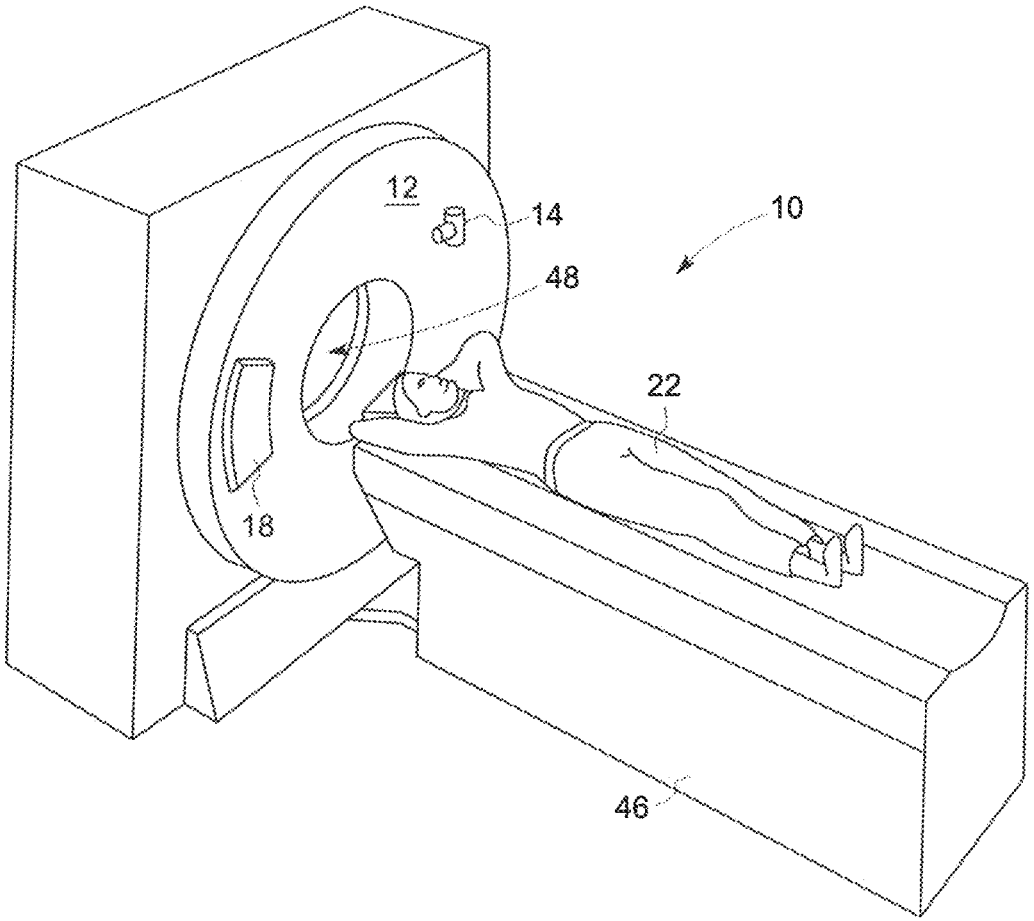
FIG. 1 is a schematic representation of a CT imaging system according to an exemplary embodiment of the invention.
Figure 2:
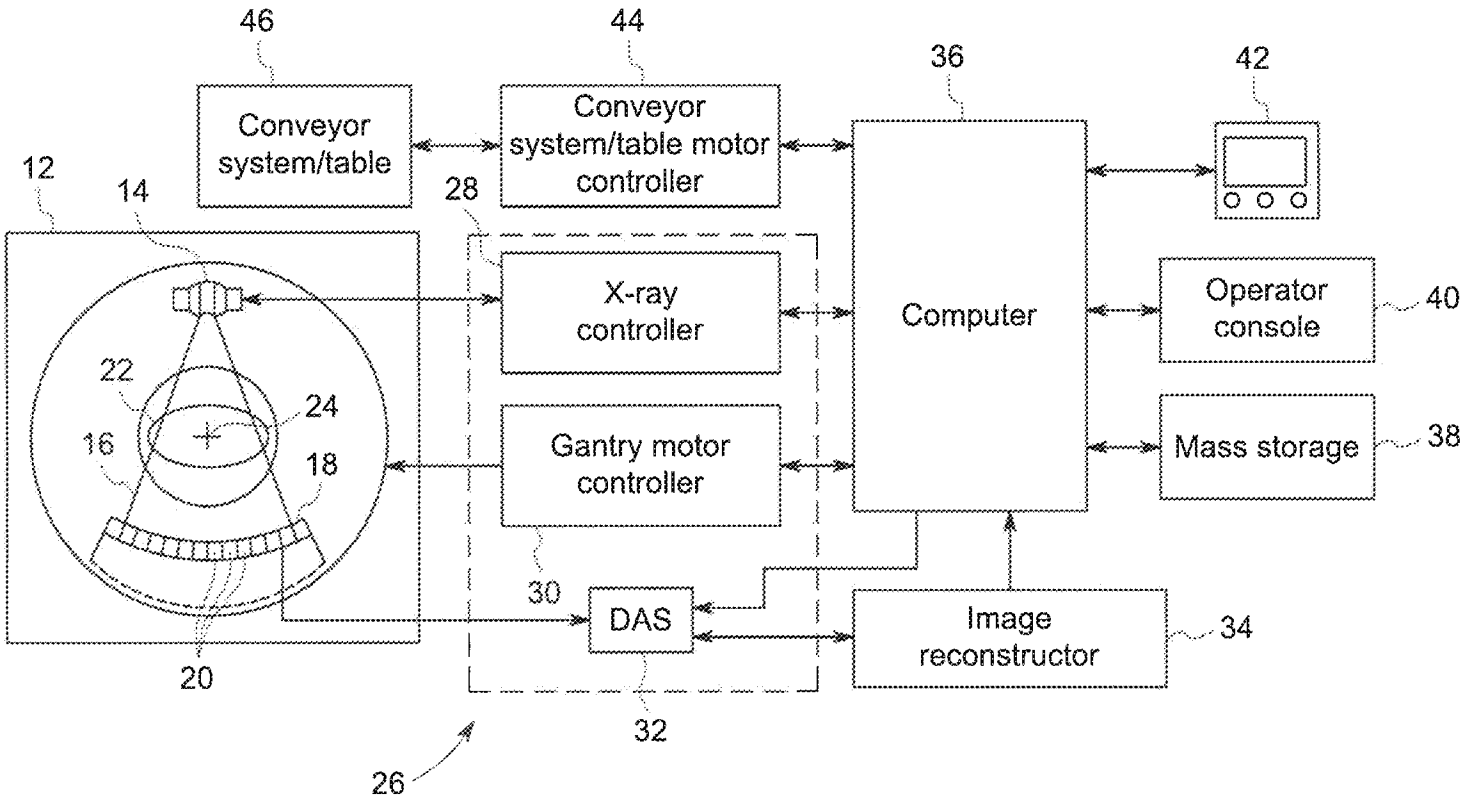
FIG. 2 is a block schematic diagram of the CT imaging system illustrated in FIG. 1.

Referring now to FIGS. 1 and 2, a computed tomography (CT) imaging system 10 is illustrated in accordance with one exemplary embodiment of the invention that includes a gantry 12 and an X-ray source 14, which typically is an X-ray tube that projects a beam of X-rays 16 towards a detector array 18 positioned opposite the X-ray tube on the gantry 12. In one embodiment, the gantry 12 may have multiple X-ray sources (along the patient theta or patient Z axis) that project beams of X-rays. The detector array 18 is formed by a plurality of detectors 20 which together sense the projected X-rays that pass through an object to be imaged, such as a patient 22. During a scan to acquire X-ray projection data, the gantry 12 and the components mounted thereon rotate about a center of rotation 24. While the CT imaging system 10 described with reference to the medical patient 22, it should be appreciated that the CT imaging system 10 may have applications outside the medical realm. For example, the CT imaging system 10 may be utilized for ascertaining the contents of closed articles, such as luggage, packages, etc., and in search of contraband such as explosives and/or biohazardous materials.

Rotation of the gantry 12 and the operation of the X-ray source 14 are governed by a control mechanism 26 of the CT system 10. The control mechanism 26 includes an X-ray controller 28 that provides power and timing signals to the X-ray source 14 and a gantry motor controller 30 that controls the rotational speed and position of the gantry 12. A data acquisition system (DAS) 32 in the control mechanism 26 samples analog data from the detectors 20 and converts the data to digital signals for subsequent processing. An image reconstructor 34 receives sampled and digitized X-ray data from the DAS 32 and performs high-speed reconstruction. The reconstructed image is applied as an input to a computer 36, which stores the image in a mass storage device 38.

Moreover, the computer 36 also receives commands and scanning parameters from an operator via operator console 40 that may have an input device such as a keyboard (not shown in FIGS. 1-2). An associated display 42 allows the operator to observe the reconstructed image and other data from the computer 36. Commands and parameters supplied by the operator are used by the computer 36 to provide control and signal information to the DAS 32, the X-ray controller 28 and the gantry motor controller 30. In addition, the computer 36 operates a table motor controller 44, which controls a motorized table 46 to position the patient 22 and the gantry 12. Particularly, the table 46 moves portions of patient 22 through a gantry opening 48. It may be noted that in certain embodiments, the computer 36 may operate a conveyor system controller 44, which controls a conveyor system 46 to position an object, such as, baggage or luggage and the gantry 12. More particularly, the conveyor system 46 moves the object through the gantry opening 48.

Figure 3:
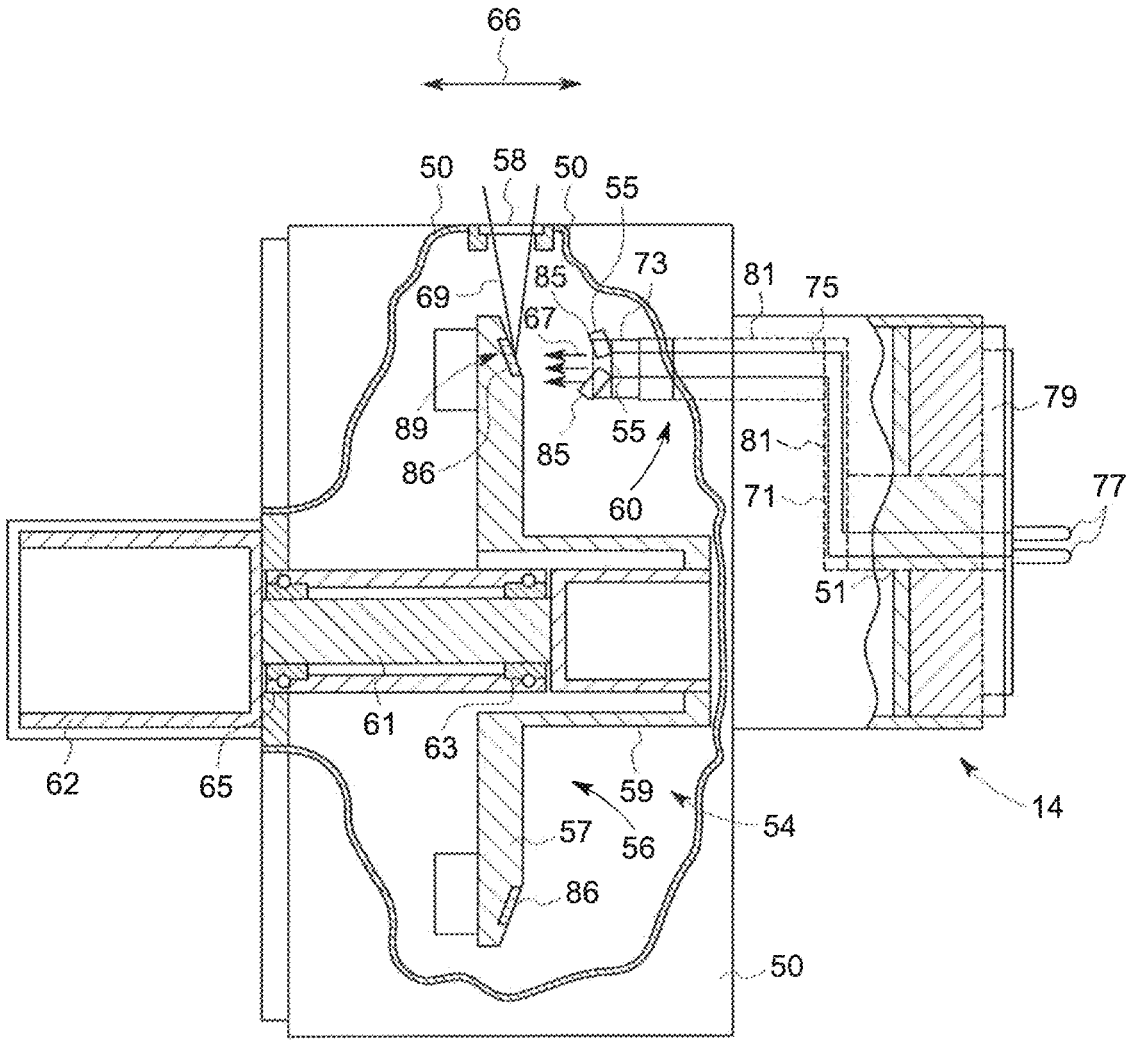
FIG. 3 is a cross-sectional view of an x-ray tube incorporating exemplary embodiments of the invention.

FIG. 3 illustrates a cross-sectional view of an x-ray tube 14 incorporating embodiments of the invention. X-ray tube 14 includes a frame 50 that encloses a vacuum region 54, and an anode 56 and a cathode assembly 60 are positioned therein. Anode 56 includes a target 57 having a target track 86, and a target hub 59 attached thereto. Terms "anode" and "target" are to be distinguished from one another, where target typically includes a location, such as a focal spot, wherein electrons impact a refractory metal with high energy in order to generate x-rays, and the term anode typically refers to an aspect of an electrical circuit which may cause acceleration of electrons theretoward. Target 56 is attached to a shaft 61 supported by a front bearing 63 and a rear bearing 65. Shaft 61 is attached to a rotor 62. Cathode assembly 60 includes a emitter support structure or cathode cup 73 and a pair of flat emitters or filaments 55, which can be formed to be identical to one another, as mirror images of one another, or differently from one another, disposed on the cup 73 at an angle with regard to one another and coupled to a current supply lead 71 and a current return 75 that each pass through a center post 51.

Feedthroughs 77 pass through an insulator 79 and are electrically connected to electrical leads 71 and 75. X-ray tube 12 includes a window 58 typically made of a low atomic number metal, such as beryllium, to allow passage of x-rays therethrough with minimum attenuation. Cathode assembly 60 includes a support arm 81 that supports emitter support structure or cathode cup 73, flat emitters 55, as well as other components thereof. Support arm 81 also provides a passage for leads 71 and 75. Cathode assembly 60 may include additional electrodes 85 that are electrically insulated from cathode cup 73 and electrically connected via leads (not shown) through support arm 81 and through insulator 79 in a fashion similar to that shown for feedthroughs 77.

In operation, target 56 is spun via a motor comprised of a stator (not shown) external to rotor 62. An electric current is applied to one of the flat emitters 55 via lead 71 which passes through the emitter 55, along an electrically connecting member 400 (FIG. 5) disposed between and connecting the emitters 55, and returns through the opposed emitter 55 though t lead 75 to heat emitters 55 and emit electrons 67 therefrom. A high-voltage electric potential is applied between anode 56 and cathode 60, and the difference therebetween accelerates the emitted electrons 67 from cathode 60 to anode 56. Electrons 67 impinge target 57 at target track 86 and x-rays 69 emit therefrom at a focal spot 89 and pass through window 58. The electrode 85 may be used to shape, deflect, or inhibit the electron beam, as is known in the art.

Figure 4:
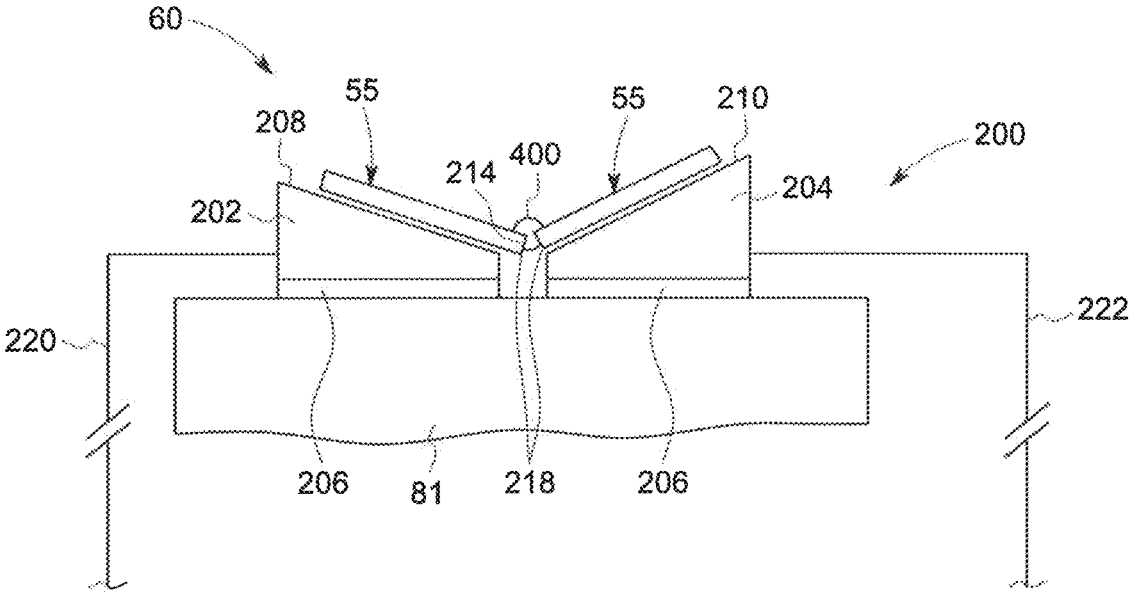
FIG. 4 is an end view of a cathode according to an exemplary embodiment of the invention.

Referring now to FIG. 4, a portion of an exemplary embodiment of a cathode assembly 60 is illustrated therein. That illustrated in FIG. 4 is illustrated from a different vantage point than that illustrated in FIG. 3. That is, length direction 226 of FIG. 4 corresponds to the length of focal spot 89 of FIG. 3, which is the profile of focal spot 89 in FIG. 3. Cathode assembly 60 in the illustrated exemplary embodiment includes cathode support arm 81 and an emitter support structure or cathode cup 200 that in one embodiment includes a first portion 202 and a second portion 204 that are connected to cathode support arm 81 and having an insulating material 206 positioned to insulate cup portions 202, 204 from cathode support arm 81. The flat emitters 55 are positioned therein to defined a gap 214 therebetween, and are mechanically coupled to cup portions 202, 204 at each end of each emitter 55. According to exemplary embodiments of the invention, the flat emitters 55 can be mechanically attached to adjacent surface 208,210 of the cup portions 202,204 using laser brazing or laser welding, as examples. According to one embodiment, first and second portions 202, 204 may each include a step or cutout portion (not shown) having a depth that is comparable to a thickness of the flat emitters 55. In such fashion, when electrons are caused to emit from a planar emitting surface of flat emitters 55, such as electrons 67 illustrated in FIG. 3, according to this embodiment electrons 67 are prevented from emitting from side edges of the emitters 55.

Electrical current is carried to the flat emitter 55 on cup portion 202 via a current supply line 220 and from the flat emitter 55 on cup portion 204 via a current return line 222 which are electrically connected to x-ray controller 28 and optionally controlled by computer 36 of system 10 in FIG. 2. Incidentally, supply and return lines 220 and 222 correspond to current supply lead 71 and current return 75 illustrated in FIG. 3. And, although supply and return lines 220, 222 are illustrated as external to cathode support arm 81, according to other embodiments, supply and return lines 220, 222 may pass through cathode support arm 81 and insulating material 206.

Figure 5:
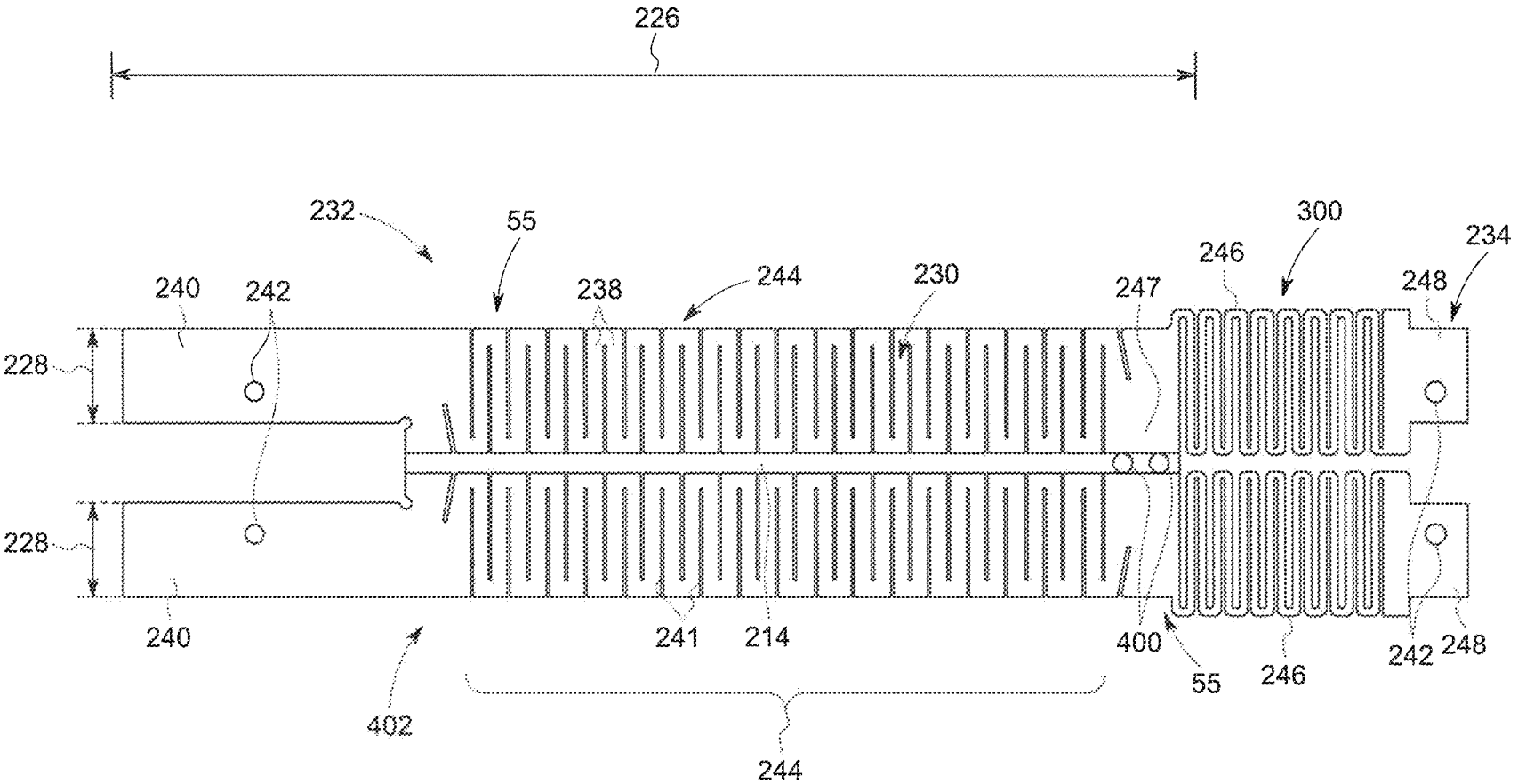
FIG. 5 is a top plan view of an electrically connected angled emitter pair accordance with an exemplary embodiment of the invention.

With reference to the illustrated exemplary embodiment of FIG. 5, and to the entire disclosure of co-pending and co-owned U.S. patent application Ser. No. 15/614,018, entitled Flat Emitters With Stress Compensation Features, the entirety of which is expressly incorporated herein for all purposes, the flat emitters 55 include a length 226 and a width 228. Length 226 corresponds to the profile view of flat emitter 55 as shown in FIG. 5, and width 228 extends normal to the profile in FIG. 5. Length 226 is greater than width 228. Further, in one exemplary embodiment the length 226 of the emitter 55 is twice as long as the width 228 enabling the emitter 55 to produce sufficient electron emission across the emission surface defined between the first mechanical engagement region 232 and second mechanical engagement region 234 defined on the emitter 55.

Each flat emitter 55 includes a cutout pattern 230 that includes a ribbon-shaped or 'back-and-forth' serpentine-like pattern of legs 238 along which current passes when a current is provided thereto. Each flat emitter 55 includes first and second mechanical engagement regions 232, 234 located at opposite ends of the emitter 55 along length 226. First and second mechanical engagement regions 232 and 234 are secured to the first and second attachment surfaces 208 and 210 of emitter support structure/cathode 200, and may be attached thereto using spot welds, line welds, braze, among other known methods.

Each emitter 55 is formed with a first contact region 232 and a second contact region 234 at opposite ends of the length 226 of the emitter 55. First region 232 is formed with a contact 240 and including a weld slot or aperture 242 adapted to be secured by a suitable welding material positioned on the contacts 240 and extending through the aperture 242 into engagement with the corresponding portion of the emitter support 200. The contact 240 is connected to an emission region 244 that is formed with a suitable emission geometry, such as with a number of alternating legs 238 separated by slots 241, with each emission regions 244 of each emitter 55 separated by the gap 214. The end of each emission region 244 adjacent the contacts 240 is operably engaged with the current supply line 220 and the return line 222 in a known manner to supply current to the emission regions 244 of the emitters 55. The regions 234 of each emitter 55 are electrically isolated so that the current flows through the emission region 244 of one emitter 55, through the connecting members 400 and returning through the emission region 244 of the other emitter 55, heating the regions 244 to a temperature of above 2000° C., and in one exemplary embodiment between 1500° C. and 3150° C., or more, in order to cause the emission region 244 to generate a flow of electrons therefrom. Additionally, the second contact region 234 includes a deflection and expansion or stress compensation feature 300 opposite the emission regions 244 adapted to compensate for the effect of the total stress in the flat emitter 55 due to thermal expansion and/or centrifugal acceleration force on the emitter 55. The feature 300 takes the form of a pair of compliance regions 246 disposed between the emission region 244 and a pair of fixed contacts 248 that each include a weld slot or aperture 242 adapted to be secured to the corresponding portion of the emitter support 200 using a suitable welding material. The compliance regions 246 are formed with a geometry that provides the compliance region 246 with a stiffness that is less than that of the emission region 244, such that the compliant region 246 is more flexible than the emission region 244.

As the emitters 55 are formed separately from one another, in order to electrically connect the emitters 55 to each other a number of electrically connecting members 400 are utilized. The members 400 are formed from a suitable electrically conductive filler material such as any refractory, high temperature alloys and pure metals, including niobium, iridium, platinum and tungsten 26% rhenium, among others. Materials having a DBTT below room temperature are preferred to minimize risk of cracking during operation. The connecting members 400 are also formed to have any desired and suitable configuration, such as a wire, or a foil or strip (formed or flat) of the conductive material cut to the desired dimensions can also be used in place of a wire to form the connecting member 400. Additionally, 3D printing technology can be utilized to pre-deposit any material(s) required for forming the connecting members 400.

Figure 6:
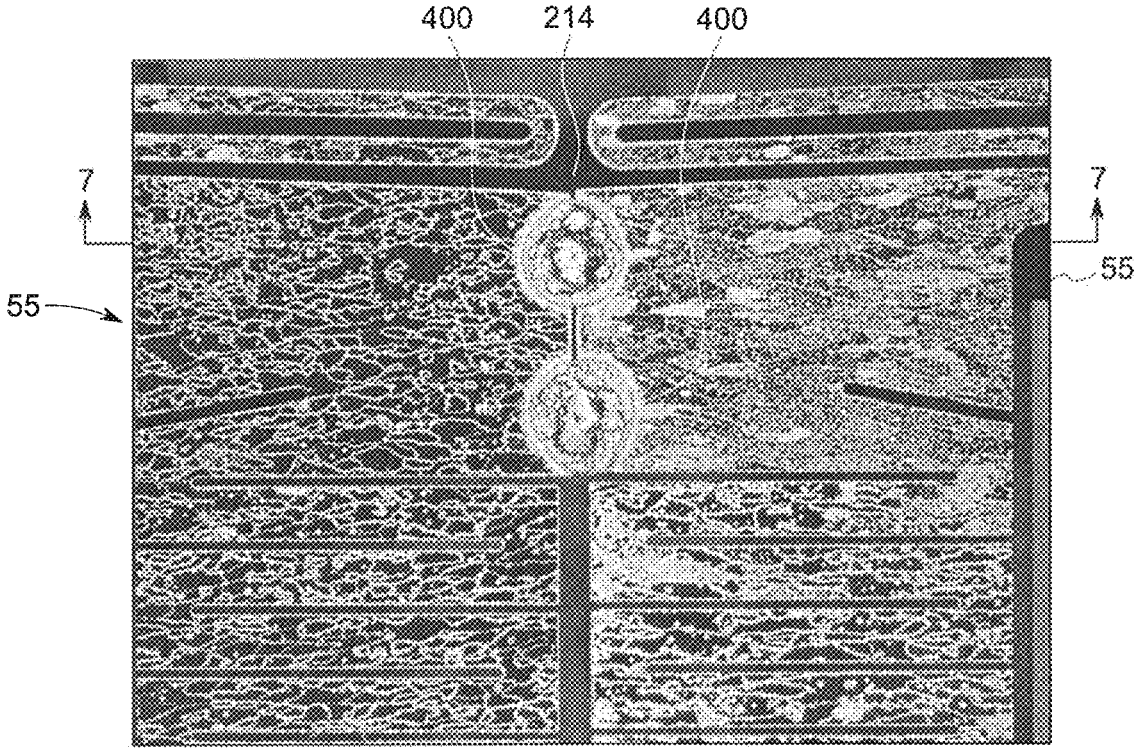
FIG. 6 is a partially broken away top plan view of electrically connecting members connecting the angled emitter pair of FIG. 6 in accordance with an exemplary embodiment of the invention.
Figure 7:
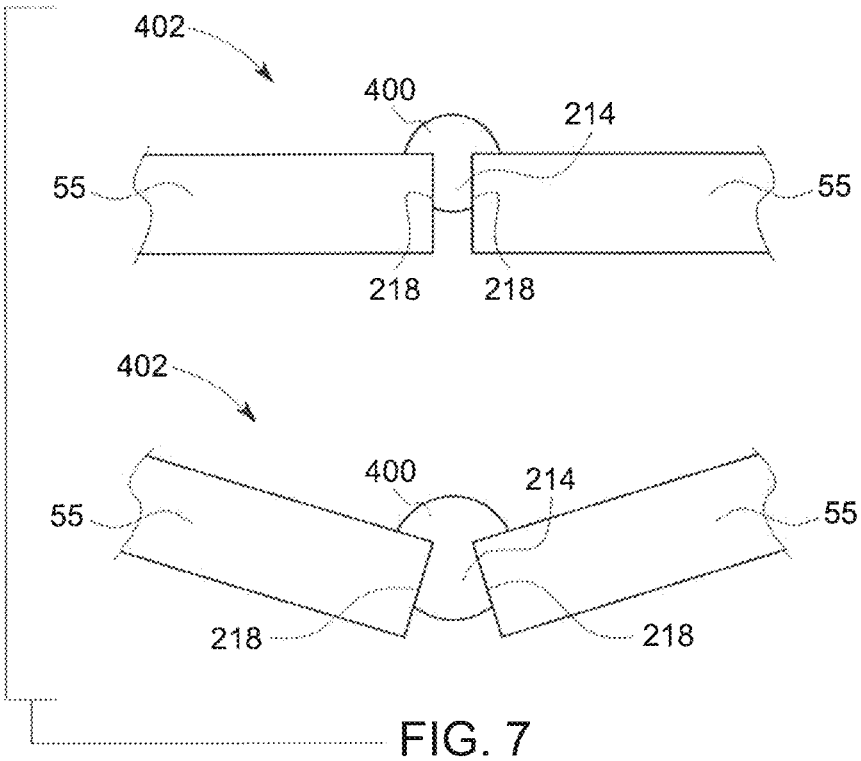
FIG. 7 are alternative cross-sectional views along line 7-7 of FIG. 6 of an electrically connecting member and straight and angled emitter pairs in accordance with exemplary embodiments of the invention.

To form the electrical connection between the emitters 55, either before or after the emitters 55 are positioned on the support structure 2000, i.e., the cup portions 202,204, and/or either before or after the emitters 55 are mechanically attached to the portions 202,204, one or more connecting members 400 are positioned over the gap 214 formed between the emitters 55, such that the connecting members 400 overlap a portion of each emitter 55. In the illustrated exemplary embodiment of FIGS. 5 and 6, the connecting members 400 are disposed adjacent second engagement regions 234 of each emitter 55, so as not to obscure any portion of the emission regions 244 on the emitters 55, and generally opposite first engagement region 232, where each emitter 55 is electrically connected to one of the current supply line 220 or the current return line 222. After placement of the connecting member 400 over the gap 214, the connecting member 400 is heated to melt the material forming the connecting member 400 and allow the connecting member 400 to form the electrical connection between the emitters 55, thus forming an emitter structure 402 with e emitters 55 and the connecting members 400. In addition to heating or welding, other forms of binding the connecting member 400 to the emitters 55 are contemplated, such as laser welding, electron beam/tig welding or any other suitable fusion bonding method. In one particular exemplary embodiment, the connecting member 400 is heated to enable the material forming the connecting member 40 to flow over and between the emitters 55, as shown in FIG. 7, but without causing the material forming the emitters 55 to soften or melt and mix with the connecting member 400. In this manner, the connecting member 400 forms a robust connection between the emitters 55 without damaging or otherwise degrading the emitters 55.

Additional connecting members 400 can be positioned over the gap 214 either simultaneously or sequentially in order to form be desired number of electrical connections between the emitters 55. As shown in FIGS. 6 and 7, the heating of the material forming the connecting member 400 enables the material to flow over portions of each emitter 55 adjacent the gap 214 as well as into the gap 214 along the side edges 218 of the emitters 55 to form a secure and reliable electrical connection between the emitters 55. In other exemplary embodiments, the gap 214 may vary in size at different areas of the emitters 55, such that the gap 214 can be formed as desired. In one exemplary embodiment, the gap 214 is narrower between adjacent second engagement regions 234 and wider between emission regions 244 to facilitate the use of the connecting members 400 to electrically interconnect the emitters 55 across the narrower section of the gap 214. In this manner, an electrical connection can quickly and readily be made between the emitters 55 oriented in a planar configuration to one another or disposed at an angle with regard to each other, as shown in FIG. 7

With this resulting electrical connection formed by the connecting members 400, an electrical connection is made between two adjacent emitters 55 that are not necessarily in a planar structure. This electrical connection is independent of the underlying support structure 73,200 to which the emitters 55 are attached and enables to independently architect the mechanical architecture separate from the electrical architecture.

As stated, referring back to FIGS. 3 and 4, once the emitters 55 are electrically connected using the number of connecting members 400, and secured to the support structure 200, a current is applied to first portion 202, which thereby flows to the adjacent flat emitter 55 through surface 208 and to first contact region 232, and then along the back-and-forth pattern of legs 238 in cutout pattern 230 for electron beam emission until reaching the connecting members 400. The connecting members 400 enable the current to flow through the connection members 400 and into the opposite emitter 55 to pass along the legs 238 in the opposite emitter 55 for electron beam creation before returning to second portion 204, back to the first contact region 232 and attachment surface 210, then passing to current return line 222.

The written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. An emitter structure adapted for use with an x-ray tube, the emitter structure comprising:

a first emitter including at least one emission region;

a second emitter including at least one emission region, the second emitter angularly disposed with respect the first emitter and spaced from the first emitter to define a gap between the first emitter and the second emitter; and at least one electrical connecting member consisting of a structure extending across the gap between the first emitter and the second emitter to connect the first and second emitters.

2. The emitter structure of claim 1 wherein the at least one electrical connecting member is formed of a material selected form the group consisting of refractory, high temperature alloys and pure metals.

3. The emitter structure of claim 2 wherein the least one electrical connecting member is formed of niobium.

4. The emitter structure of claim 1 wherein the at least one electrical connecting member is formed of a wire.

5. The emitter structure of claim 1 wherein the at least one electrical connecting member is formed of a foil.

6. The emitter structure of claim 1 wherein the at least one electrical connecting member is positioned above the gap.

7. The emitter structure of claim 6 wherein the at least one electrical connecting member is positioned within the gap between the first emitter and the second emitter.

8. The emitter structure of claim 1 wherein the at least one electrical connecting member is heated to connect the at least one electrical connecting member to the first emitter and the second emitter.

9. The emitter structure of claim 8 wherein the at least one electrical connecting member is welded to the first emitter and the second emitter.

10. The emitter structure of claim 1 wherein the at least one electrical connecting member is spaced from the emission regions.

11. An x-ray tube comprising:

a cathode assembly; and an anode assembly spaced from the cathode assembly, wherein the cathode assembly comprises:

an emitter support structure; and an emitter structure disposed on the emitter support structure, the emitter including a first emitter including at least one emission region, a second emitter including at least one emission region, the second emitter angularly disposed with respect the first emitter and spaced from the first emitter to define a gap between the first emitter and the second emitter; and at least one electrical connecting member consisting of a structure extending across the gap between the first emitter and the second emitter to connect the first and second emitters.

12. The x-ray tube of claim 11 wherein the at least one electrical connecting member does not contact the emitter support structure.

13. A method for forming an emitter structure used in an x-ray tube, the method comprising the steps of:

providing a first emitter including at least one emission region;

providing a second emitter including at least one emission region;

positioning the first emitter and the second emitter adjacent one another to define a gap between the first emitter and the second emitter; and securing at least one electrical connecting member between the first emitter and the second emitter across the gap to connect the first and second emitters.

14. The method of claim 13 wherein the step of positioning the first emitter and the second emitter adjacent one another comprises placing the first emitter and the second emitter onto an emitter support structure.

15. The method of claim 14 wherein the step of positioning the first emitter and the second emitter onto the emitter support structure comprises placing the first emitter and the second emitter on the emitter support structure at an angle with respect to one another.

16. The method of claim 14 wherein the at least one electrical connecting member does not contact the emitter support structure.

17. The method of claim 14 further comprising the step of securing the first emitter and the second emitter to the emitter support structure after securing at least one electrical connecting member between the first emitter and the second emitter across the gap.

18. The method of claim 13 wherein the step of securing the at least one electrical connecting member between the first emitter and the second emitter across the gap comprises heating the at least one electrical connecting member.

19. The method of claim 13 wherein the step of securing the at least one electrical connecting member between the first emitter and the second emitter across the gap comprises positioning the at least one securing member above the gap between the first emitter and the second emitter and within the gap between the first emitter and the second emitter.

20. The method of claim 13 wherein the step of securing the at least one electrical connecting member between the first emitter and the second emitter across the gap comprises the steps of;

securing a first electrical connecting member between the first emitter and the second emitter across the gap; and securing a second electrical connecting member between the first emitter and the second emitter across the gap and spaced from the first electrical connecting member.

* * * * *